United States Patent [19]

Cuevas-Cumming

[11] Patent Number: 4,603,925

[45] Date of Patent: Aug. 5, 1986

[54] PERSONAL COMPUTER STORAGE CABINET

[75] Inventor: Pablo Cuevas-Cumming, Walled Lake, Mich.

[73] Assignee: Chrysler Corporation, Highland Park, Mich.

[21] Appl. No.: 758,943

[22] Filed: Jul. 25, 1985

[51] Int. Cl.[4] ..... A47B 17/00; E05D 15/58

[52] U.S. Cl. ..... 312/196; 312/311; 312/351; 312/349; 49/254

[58] Field of Search ..... 312/110, 196, 311, 318, 312/349, 350, 351; 49/254, 260, 257

[56] References Cited

U.S. PATENT DOCUMENTS

| | | | |
|---|---|---|---|
| 464,521 | 12/1891 | Posz | 312/196 |
| 1,922,487 | 8/1933 | Meilink | 49/257 |
| 2,223,196 | 11/1940 | Watkins | 312/223 |
| 2,853,355 | 9/1958 | Paca et al. | 312/311 |

*Primary Examiner*—William E. Lyddane
*Assistant Examiner*—Gerald A. Anderson
*Attorney, Agent, or Firm*—Edward A. Craig

[57] ABSTRACT

A personal computer storage cabinet is provided. The cabinet is interiorly arranged for suitable storage and use of a personal computer and associated equipment such as a printer, TV monitor and software. A retractable front door is provided. The door may be securely locked when the computer equipment is not in use. The door retracts and is storable beneath the cabinet when the computer equipment is in use.

4 Claims, 4 Drawing Figures

PERSONAL COMPUTER STORAGE CABINET

BACKGROUND OF THE INVENTION

Recently, personal computers have come into widespread use in various departments of business operations. Personal computers, which are relatively small in size, have proved to be very useful on an individual basis for various technical personnel, such as engineers, designers, technicians, and also for other business personnel such as marketing people and financial personnel.

Personal computers are relatively expensive items and, being relatively small in size, have become the object of theft. The computer and associated equipment and software can easily be transported out of an open office environment and be hand carried out of business premises.

The present invention provides a personal computer cabinet structure which may be securely and easily locked when the computer is not in use, as during evening and night hours and on weekends. At the same time, the cabinet is easily opened and so designed interiorly as to permit ready storage of the normal personal computer and associated equipment. The interior structure is designed to permit ready access to portions of the computer equipment which must be manually activated or used for some mechanical purpose such as printing. It is designed to be of simple manufacture and to take up a minimum of space.

SUMMARY OF THE INVENTION

The personal computer storage cabinet includes a cabinet portion having side panels, a back panel and a top panel, which define an enclosed storage space having a front access opening for personal computer equipment. A retractable door is provided. The door is movable from a closed position in which it covers the access opening to an open position stored beneath the cabinet portion in which it uncovers the access opening to permit operation of personal computer equipment stored within the cabinet. The door has an upper edge and a lower edge. A pinion is rotatably mounted on each end of the lower door edge. An elongated gear rack is mounted under each pinion beneath the cabinet bottom panel. Each of the gear racks is in engagement with its respective pinion. The gear racks extend from the front to the rear of the cabinet portion. The door is pivotal about the pinions and movable by means of the pinions and the gear racks to its open and closed positions. Support means are provided on the cabinet portion to engage the door for retaining the door in its open position. Locking means are provided on the door adjacent the upper edge thereof to engage the cabinet portion for locking the door in its closed position.

The support means on the cabinet portion comprise a bracket secured to the underside of the cabinet portion. The bracket includes a portion extending forwardly of the cabinet portion and terminating in an upturned end portion. The retractable door has a flange on the upper edge. This flange has opening means to receive the forwardly extending bracket portion to support the upper edge of the door when the door is moved to its open position stored beneath the cabinet portion. The upturned end portion of the bracket prevents inadvertent release of the door.

A horizontal shelf is provided in the cabinet portion dividing the enclosed storage space into upper and lower compartments. The forward portions of the cabinet side panels are angled rearwardly from the lower to the upper edges thereto whereby the lower compartment extends forwardly of the upper compartment to permit access to a computer key board which may be stored in the cabinet portion. The shelf terminates short of the back panel to permit circulation of air between the upper and lower compartments.

A light fixture is provided in the upper compartment on one side of the cabinet to provide lighting but to prevent glare on a TV monitor which may be stored on the other side of the cabinet portion.

DESCRIPTION OF THE PREFERRED EMBODIMENT

Figure 1:
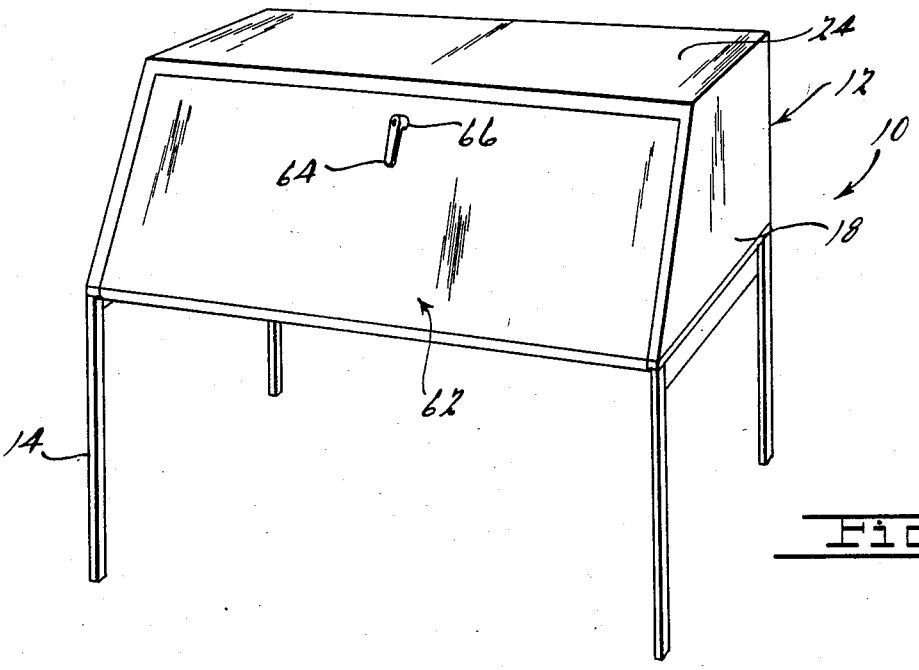
FIG. 1 is a view in perspective of a personal computer storage cabinet illustrating one embodiment of the present invention.

Referring to the figures, it will be noted that the personal computer storage cabinet 10 comprises a cabinet portion 12 supported and spaced from the floor by means of four ground engaging legs 14. The cabinet portion 12 comprises side panels 16, 18, back panel 20, bottom panel 22, and top panel 24 which are functionally secured together and supported by the legs 14. These panels define an enclosed storage space having a front access opening for personal computer equipment. This space is divided into upper and lower compartments by horizontally extending shelf 26. The inner edge 28 of the shelf 26 terminates about three inches short of the back panel 20 to allow for air circulation within the cabinet.

Figure 2:
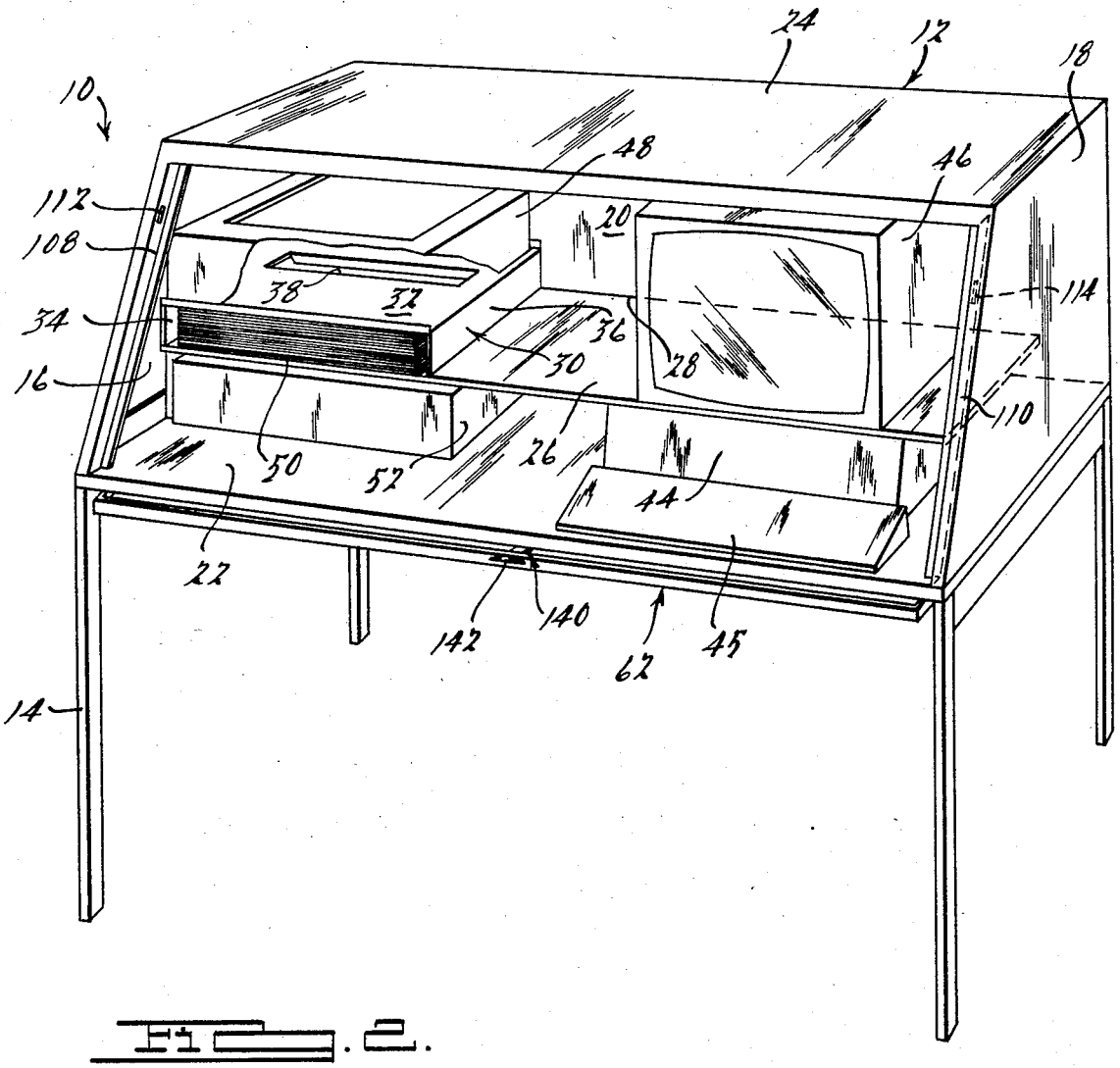
FIG. 2 is a view in perspective of the computer storage cabinet with the retractable door in the open position and stored on the underside of the cabinet.

As will be noted in FIG. 2, a paper tray 30 is secured on the shelf 26 adjacent the left side panel 16 as viewed in FIG. 2. The tray 30 comprises an upper tray panel 32 and tray side panels 34, 36 which are secured to the shelf 26. A paper-feed slot 38 is provided in the tray panel 32. Horizontally extending parallel slots 40, 42 are provided in the cabinet back panel 20 (FIG. 3) beneath the shelf 26 and a third slot 43 parallel to slots 40, 42 is provided in the back panel 20 above the shelf 26. These slots function to permit circulation of air within the cabinet portion 12.

Referring to FIG. 1, it will be noted that a personal computer 44 and associated equipment are conveniently mounted within cabinet portion 12. The personal computer 44 is mounted on the cabinet bottom panel 22. The side panels 16, 18 are angled rearwardly from the bottom to the top thereof with the result that the shelf 26 terminates short of the bottom panel 22. This results in the lower compartment extending forwardly of the upper compartment and makes the keyboard 45 of the computer available to an operator. A TV monitor 46 is illustratively mounted above the personal computer 44 on shelf 26. These elements are mounted on the right side of the cabinet portion 12 as viewed in FIG. 2. On the left side of the cabinet portion are illustratively mounted a printer 48 which is positioned on top of the paper tray 30 on the tray panel 32. Paper 50 for the printer 48 is loaded in the paper tray 30. Beneath the paper tray is space for a plotter 52. The plotter 52 rests on the bottom cabinet panel 22. The space between the TV monitor 46 and paper tray 30 may be utilized as, for example, for software storage. The overall arrangement provides a very convenient setting for the operator of the computer.

Figure 3:
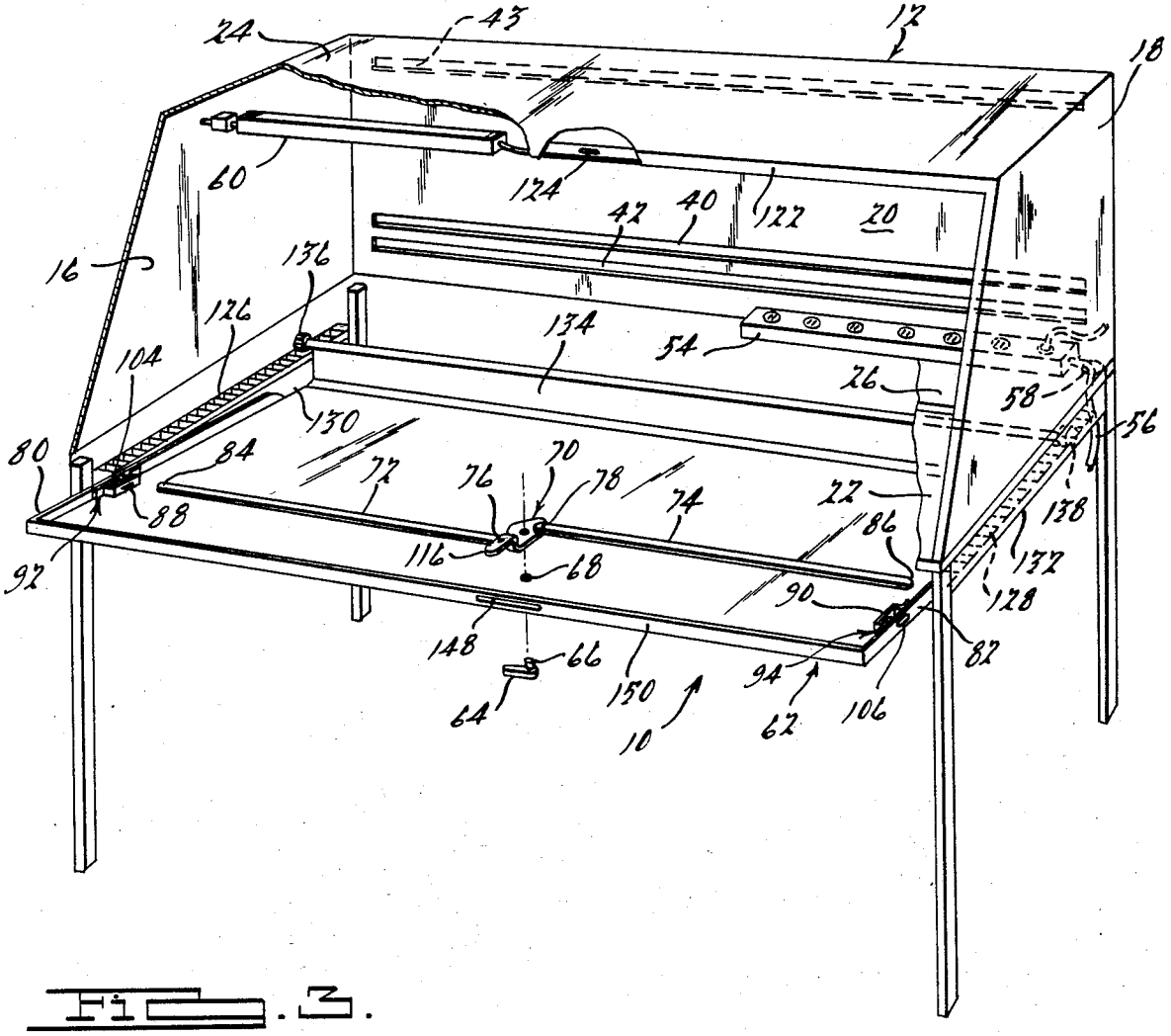
FIG. 3 is a view in perspective of the computer storage cabinet with the retractable door in the open position and with portions of the cabinet broken away for the purpose of clarity.

A multiple socket electrical connector 54 (FIG. 3) is mounted on the cabinet bottom panel 22 adjacent the cabinet back panel 20 on the right hand side as viewed in FIG. 3. A power cord 56 extends from the connector 54 through an opening 58 provided in the bottom panel 22 and is plugged into a convenient electrical outlet. The sockets of the connector 54 may be used as needed for the various computer components. Also, a fluorescent lamp fixture may be plugged into the connector. A lamp fixture 60 is mounted on the forward portion of the underside of the top panel 24 adjacent the left side of the cabinet as viewed in FIG. 3. The lamp fixture 60 provides illumination for the cabinet. It will be noted that the fixture 60 is relatively short and does not extend beyond the midpoint of the cabinet. The reason for this is to prevent the lamp from creating a glare or reflection on the screen of the TV monitor 46 located on the other side of the cabinet portion.

Figure 4:
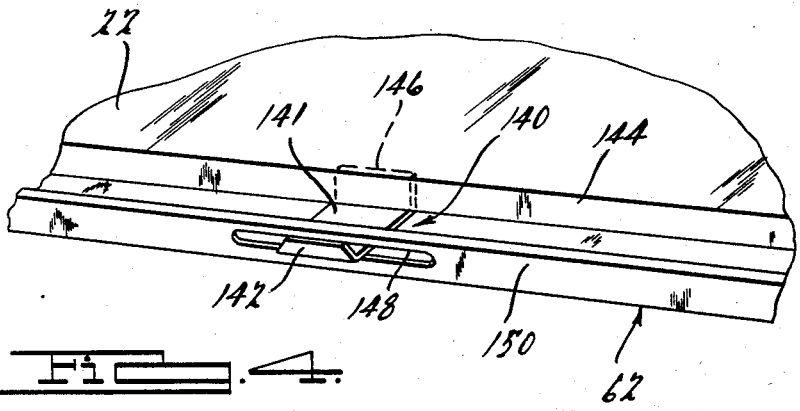
FIG. 4 is a view in perspective illustrating the means for supporting the forward portion of the retractable door in the storage position.

The computer storage cabinet 10 is provided with a retractable door 62 on the front portion thereof which may be closed to cover the access opening and locked in a secure position as shown in FIG. 1 or opened and stored on the underside of the cabinet bottom wall 22 as illustrated in FIGS. 2 and 4. When the door 62 is closed and locked as in FIG. 1, the contents of the computer cabinet are secured from theft. When the door is opened and stored, the computer equipment within the cabinet is available for use.

A three point locking system is provided to secure the door 62 in the closed position. As best shown in FIG. 3, the locking system comprises a handle 64 which has an integral key-operated lock mechanism 66. The lock mechanism 66 extends through an opening 68 provided in the door 62 adjacent the upper edge thereof. The lock mechanism 66 is secured to a bracket 70 which is located on the inner face of the door. A pair of elongated locking bars 72, 74 are pivotally connected at one end 76, 78 to the bracket 70. The bars 72, 74 extend from the bracket 70 through the side edge flanges 80, 82 of the door 62. The outer ends 84, 86 of the bars are received through slots 88, 90 provided in brackets 92, 94 and slots 104, 106 provided in door flanges 80, 82. The brackets 92, 94 are secured to flanges 96, 98 of the door and have outwardly spaced portions in which the slots 88, 90 are provided. This permits the outer ends of the bars to be held securely. Mating locking slots 112, 114 (FIG. 2) are provided in the cabinet side panel interior flanges 108, 110. This arrangement permits the ends of the locking bars 72, 74 to be moved in or out of engagement with slots 112, 114 by turning of the handle 64, with the door 62 in the closed position shown in FIG. 1. This provides two points of the three point locking system.

The third point of the locking system is provided by means of the bracket 70. As will be noted in FIG. 3, a catch 116 extends from the bracket 70. The catch 116 extends towards the upper edge of the door 62. The top cabinet panel 24 has a horizontally extending flange 122 which has a slot 124. When the handle 64 is turned to engage the locking bars 72, 74 with the side panels 16, 18, the catch 116 is rotated through the slot 124 to a position where it provides the third point of the three point locking system. Thus, the door 62 is secured against being pried open from either the top or the sides.

The door 62 is manipulated between its open and closed positions by means of a rack and pinion construction. As will be noted in FIG. 3, a pair of oppositely disposed elongated gear racks 126, 128 extending from the front to the rear of the cabinet portion are mounted beneath, and spaced from, the cabinet bottom panel 22 at each end thereof by means of side guide panels 130, 132. The door 62 has a flange 134 at the lower edge thereof upon which are rotatably mounted a pair of pinions 136, 138 each of which operatively engage one of the racks 126, 128. Thus, the door 62 is guided in its opening and closing movements, with the pinions 136, 138 permitting pivoting of the door as necessary from its open to its closed position.

Referring to FIG. 4, it will be noted that support means are provided for securing the door 62 in its stored position beneath the cabinet bottom panel 22. A bracket 140 having an upturned end portion 142 is secured to the bottom panel 22 front flange 144 by means of bracket flange portion 146. An opening 148 is provided in upper edge door flange 150. When the door 62 is moved to its storage position, the bracket portion 141 is received through slot 148 thus supporting the upper edge portion of the door in its stored position beneath the cabinet portion. The upturned end portion 142 prevents inadvertent release of the door.

Having thus described by invention, I claim:

1. A personal computer storage cabinet comprising a cabinet portion having side panels, a back panel, a bottom panel and a top panel defining an enclosed storage space having a front access opening for personal computer equipment, a retractable door movable from a closed position in which it covers the access opening to an open position stored beneath the cabinet portion in which it uncovers the access opening to permit operation of personal computer equipment stored within the cabinet, said door having an upper edge and a lower edge, a pinion rotably mounted on each end of the lower door edge, an elongated gear rack mounted under each pinion beneath, and spaced from, the cabinet bottom panel, each of said gear racks being in engagement with its respective pinion and extending from the front to the rear of the cabinet portion, said door being pivotable about the pinions and movable by means of said pinions in the gear racks to its open and closed positions, support means provided on the cabinet portion to engage the door for retaining the door in its open position, and locking means on the door adjacent the upper edge thereof cooperating with engagement means on the cabinet portion for locking the door in its closed position, said support means on the cabinet portion comprising a bracket secured to the underside of the cabinet portion, said bracket including a portion extending forwardly of the cabinet portion and terminating in an upturned end portion, said retractable door having a flange on the upper edge, said flange having opening means to receive said forwardly extending bracket portion to support the upper edge of the door when the door is moved to its open position stored beneath the cabinet portion, said upturned end portion of the bracket preventing inadvertent release of the door.

2. A personal computer storage cabinet as defined in claim 1, further characterized in the provision of a horizontally extending shelf within the cabinet portion dividing the enclosed storage space into upper and lower compartments, the forward portion of said side panels being angled rearwardly from the lower to the upper edges thereof whereby the lower compartment extends forwardly of said upper compartment to permit access to a computer keyboard which may be stored in the cabinet portion.

3. A personal computer storage cabinet as defined in claim 2, further characterized in that said shelf terminates short of the back panels to permit circulation of air between the upper and lower compartments.

4. A personal computer storage cabinet as defined in claim 2, further characterized in the provision of a light fixture within said upper compartment located to one side of the cabinet portion to provide lighting but to prevent glare on a TV monitor which may be stored on the other side of the cabinet portion.

* * * * *